US007878188B2

(12) United States Patent
Barksdale

(10) Patent No.: US 7,878,188 B2
(45) Date of Patent: Feb. 1, 2011

(54) SELF-HEATING BEVERAGE CONTAINER

(76) Inventor: Jonathan E. Barksdale, 1011 S. Charles St., Belleville, IL (US) 62220

( * ) Notice: Subject to any disclaimer, the term of this patent is extended or adjusted under 35 U.S.C. 154(b) by 1115 days.

(21) Appl. No.: 11/535,297

(22) Filed: Sep. 26, 2006

(65) Prior Publication Data

US 2008/0072765 A1 Mar. 27, 2008

(51) Int. Cl.
*F24J 1/00* (2006.01)

(52) U.S. Cl. ..... 126/263.09; 126/262; 126/263.05; 126/263.06; 220/254.2; 220/592.06

(58) Field of Classification Search ..... 99/275, 99/483; 126/263.05–263.09, 262; 220/254.2, 220/592.06, 532.16

See application file for complete search history.

(56) References Cited

U.S. PATENT DOCUMENTS

| | | | | |
|---|---|---|---|---|
| 3,970,068 | A | 7/1976 | Sato | |
| 4,528,218 | A | 7/1985 | Maione | |
| 5,626,022 | A * | 5/1997 | Scudder et al. | 62/4 |
| 6,079,405 | A | 6/2000 | Justo | |
| 6,267,110 | B1 * | 7/2001 | Tenenboum et al. | 126/263.01 |
| 6,338,252 | B1 * | 1/2002 | Calderaio | 62/4 |
| 6,708,833 | B2 * | 3/2004 | Kolb | 215/11.1 |
| 6,880,550 | B2 * | 4/2005 | Miller et al. | 126/263.09 |
| 6,962,149 | B2 * | 11/2005 | Kolb | 126/263.08 |
| 7,004,161 | B2 * | 2/2006 | Kolb | 126/263.09 |
| 2002/0005437 | A1 * | 1/2002 | Ketcha et al. | 239/13 |
| 2006/0213858 | A1 * | 9/2006 | Kraus et al. | 215/11.1 |

* cited by examiner

*Primary Examiner*—Tu B Hoang
*Assistant Examiner*—Jianying Atkisson
(74) *Attorney, Agent, or Firm*—Dale J. Ream

(57) ABSTRACT

A self-heating beverage container includes a housing defining an open interior area for holding a liquid and defining a cavity separated from the open interior area. The container includes a heater portion removably coupled to the housing within the cavity. First and second reactants may be positioned in the cartridge area where they may be selectively combined to produce heat when a seal between them is punctured, causing the liquid to be heated. The container includes a selection portion that is selectively separable from the housing. A plurality of flavoring agents is positioned in the selection portion, each flavoring agent being separated from each other flavoring agent. Each flavoring agent is selectively separated from said open interior area by at least one breakable barrier. Each breakable barrier may be selectively pierced so as to dispense an ingredient into the liquid where it may be selectively mixed and heated.

11 Claims, 9 Drawing Sheets

SELF-HEATING BEVERAGE CONTAINER

BACKGROUND OF THE INVENTION

This invention relates generally to beverage containers and, more particularly, to a self-heating beverage container for selectively mixing and heating ingredients with a liquid.

The consumption of hot beverages such as coffee, tea, hot chocolate, and the like while traveling, commuting, or otherwise during a person's busy schedule has become very common and desired. One problem with a consumer's desire to have a hot beverage at any time during his busy schedule is that the beverage may not be immediately accessible. For example, the consumer may not be physically near a restaurant, gas station, or convenience store that may have hot beverages. Or, the limited range of choices for a hot beverage may not be acceptable to the consumer.

Various devices have been proposed in the art for mixing ingredients together to create another form of food or liquid. Although presumably effective for their intended purposes, the existing devices do not provide a prepackaged selection of ingredients that may be selectively mixed with water or other liquid and self-heated within the same container.

Therefore, it would be desirable to have a self-heating beverage container in which solid ingredients such as coffee, tea, or hot chocolate may be selectively mixed with a liquid and self-heated within a single beverage container. Further, it would be desirable to have a self-heating beverage container having a heat cartridge that may be selectively activated to heat the liquid at a desired time. In addition, it would be desirable to have a self-heating beverage container that indicates the temperature of the liquid inside.

SUMMARY OF THE INVENTION

Accordingly, a self-heating beverage container according to the present invention includes a housing having upper and lower ends and defining an open interior area (e.g. for holding water or another liquid), the lower end defining a cavity adjacent and separated from the open interior area. The beverage container includes a heater portion removably coupled to the housing, the heater portion having a wall defining a cartridge area and being within the cavity when the heater portion is coupled to the housing. First and second reactants may be positioned in the cartridge area where they may be selectively combined to produce heat when a seal between them is punctured. This causes the liquid to be heated.

The self-heating beverage container further includes a selection portion having a configuration complementary to a configuration of the housing for placement upwardly adjacent the at least one secondary opening, the selection portion being selectively separable from the housing. A plurality of flavoring agents is positioned in the selection portion, each flavoring agent being separated from each other flavoring agent. Each flavoring agent being selectively separated from said open interior area by at least one breakable barrier. The beverage container includes a means for piercing the at least one breakable barrier and a cap for covering the primary opening.

Therefore, a general object of this invention is to provide a self-heating beverage container for mixing, heating, and delivering a hot beverage without an external heat source.

Another object of this invention is to provide a self-heating beverage container, as aforesaid, having a selection portion for a user to selectively dispense a flavoring ingredient into a liquid.

Still another object of this invention is to provide a self-heating beverage container, as aforesaid, having a heater portion having at least first and second reactants that may be selectively combined to produce heat for heating the liquid.

Yet another object of this invention is to provide a self-heating beverage container, as aforesaid, having a temperature indicator.

A further object of this invention is to provide a self-heating beverage container, as aforesaid, in which the heater portion is a cartridge that may be removed and replaced.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
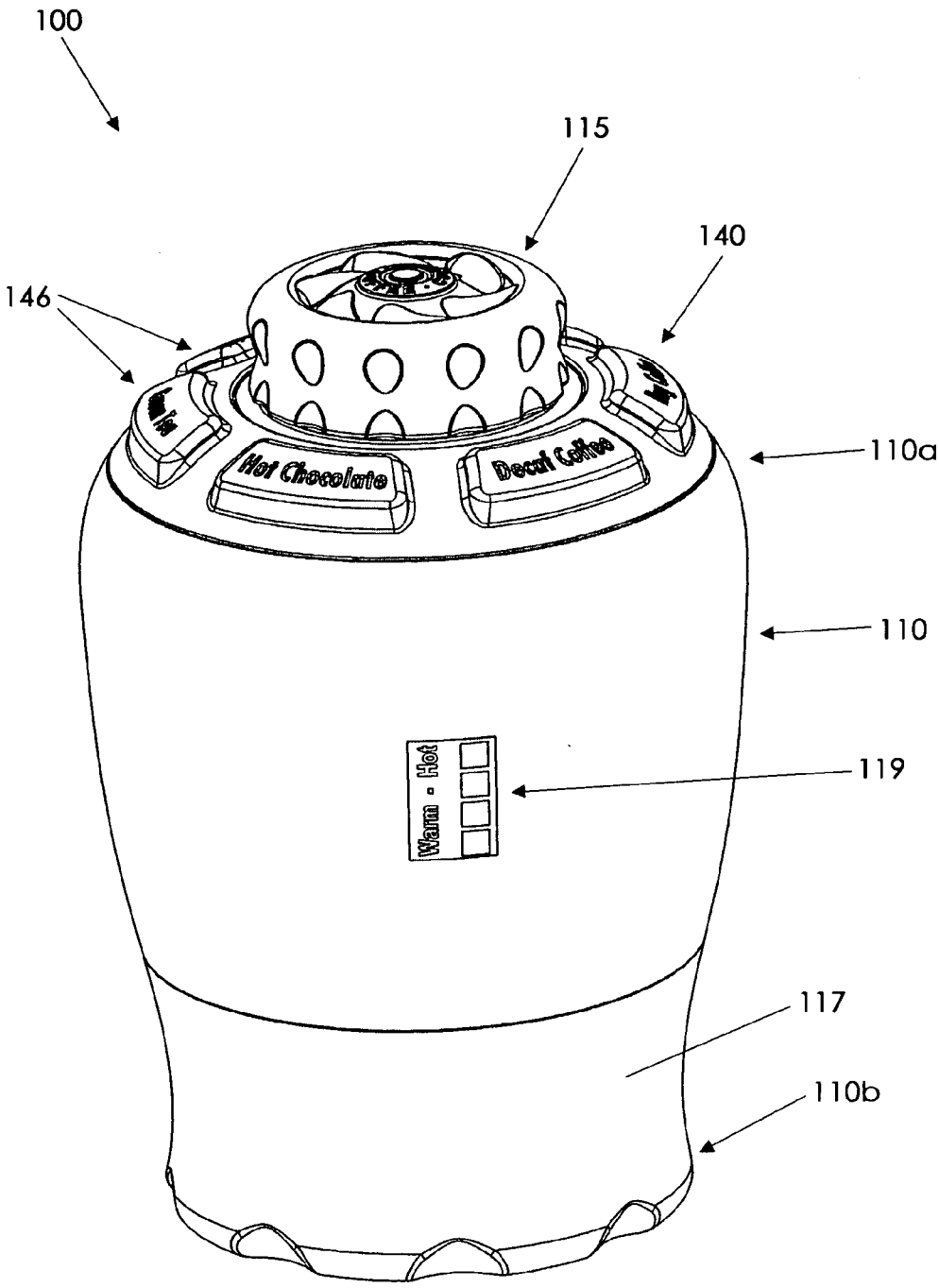
FIG. 1 is a perspective view of a self-heating beverage container according to a preferred embodiment of the present invention.

A self-heating beverage container 100 according to the present invention will now be described in detail with reference to FIGS. 1 through 9 of the accompanying drawings. More particularly, a self-heating beverage container 100 according to the current invention includes a housing 110, a heater portion 120, and a selection portion 140.

Figure 2A:
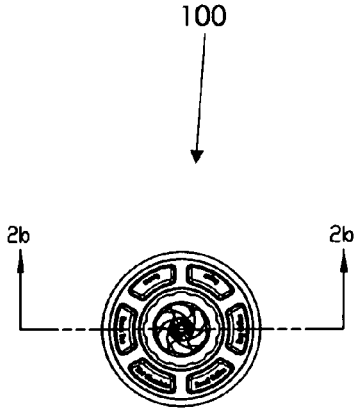
FIG. 2*a* is a top view of the beverage container as in FIG. 1.
Figure 2B:
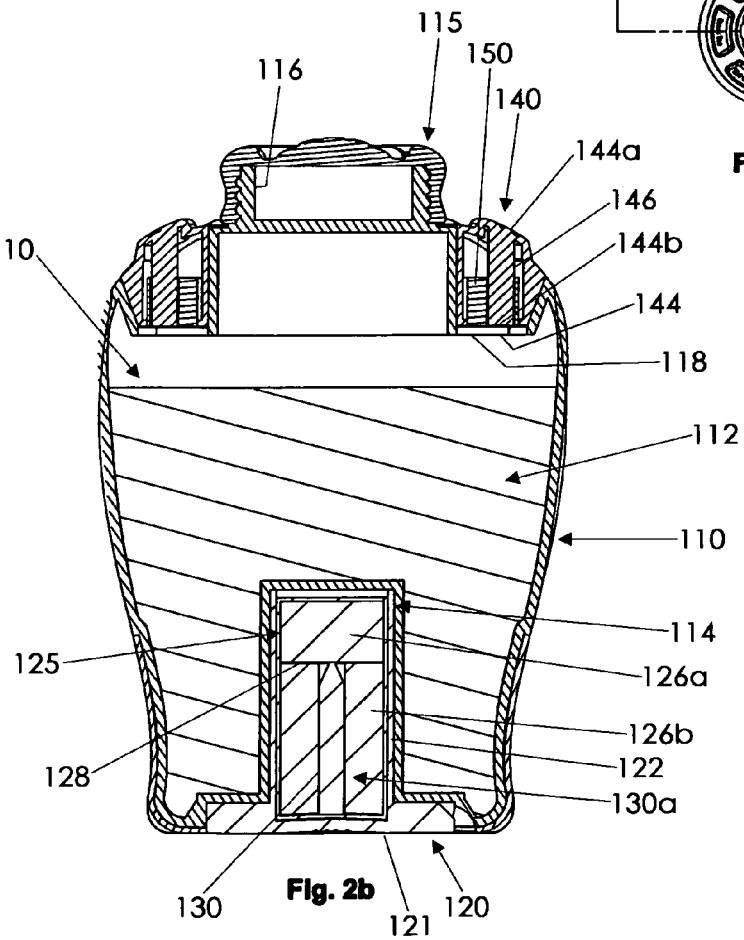
FIG. 2*b* is a sectional view taken along line 2*b*-2*b* of FIG. 2*a* with a spear in a lowered position.
Figures 3A, 3B:
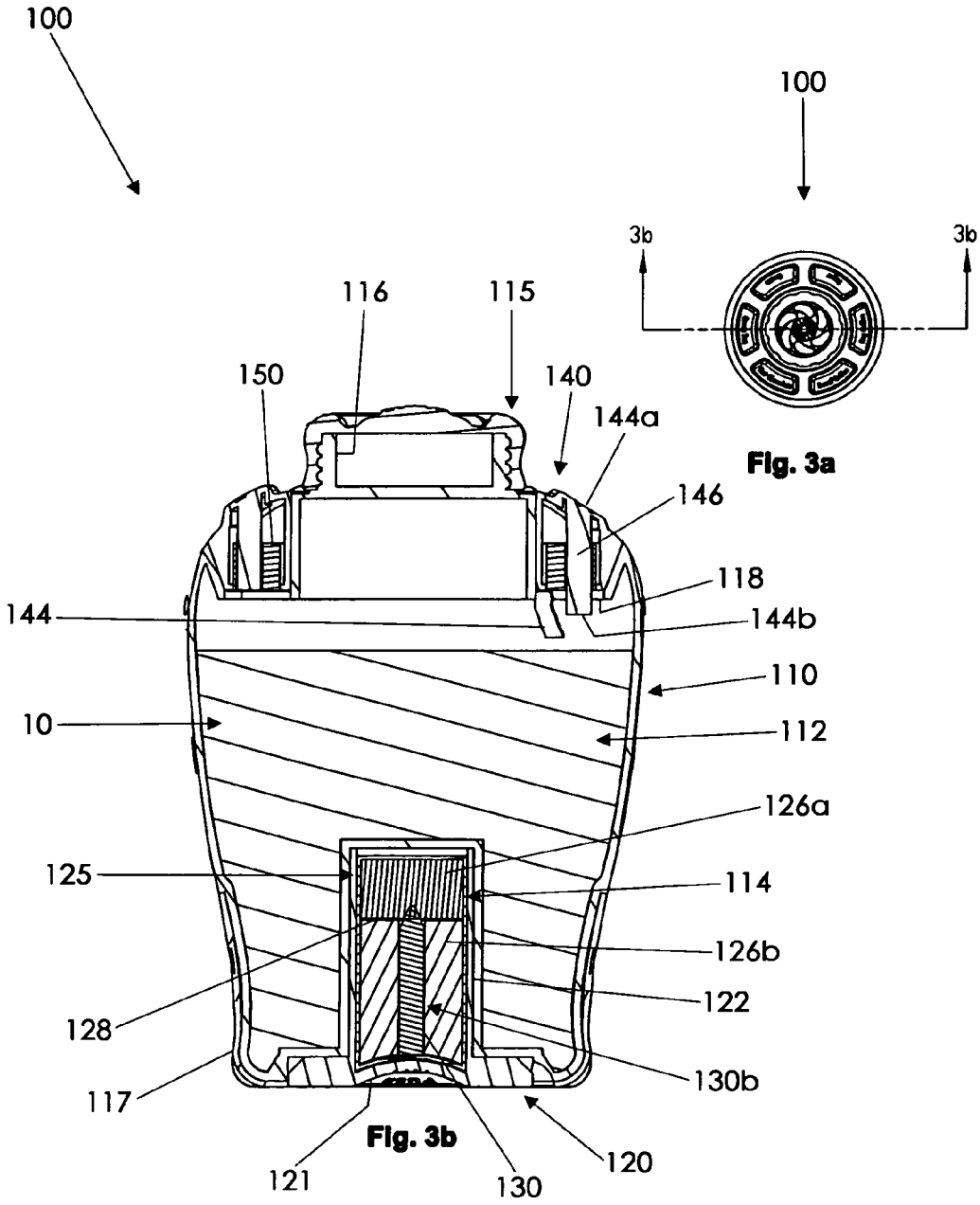
FIG. 3*a* is another top view of the beverage container as in FIG. 1.
FIG. 3*b* is a sectional view taken along line 3*b*-3*b* of FIG. 3*a* with a spear in a raised configuration.

The housing 110 has upper and lower ends 110*a*, 110*b* and defines an open interior area 112 as shown in FIGS. 2*b* and 3*b*.

Figure 4:
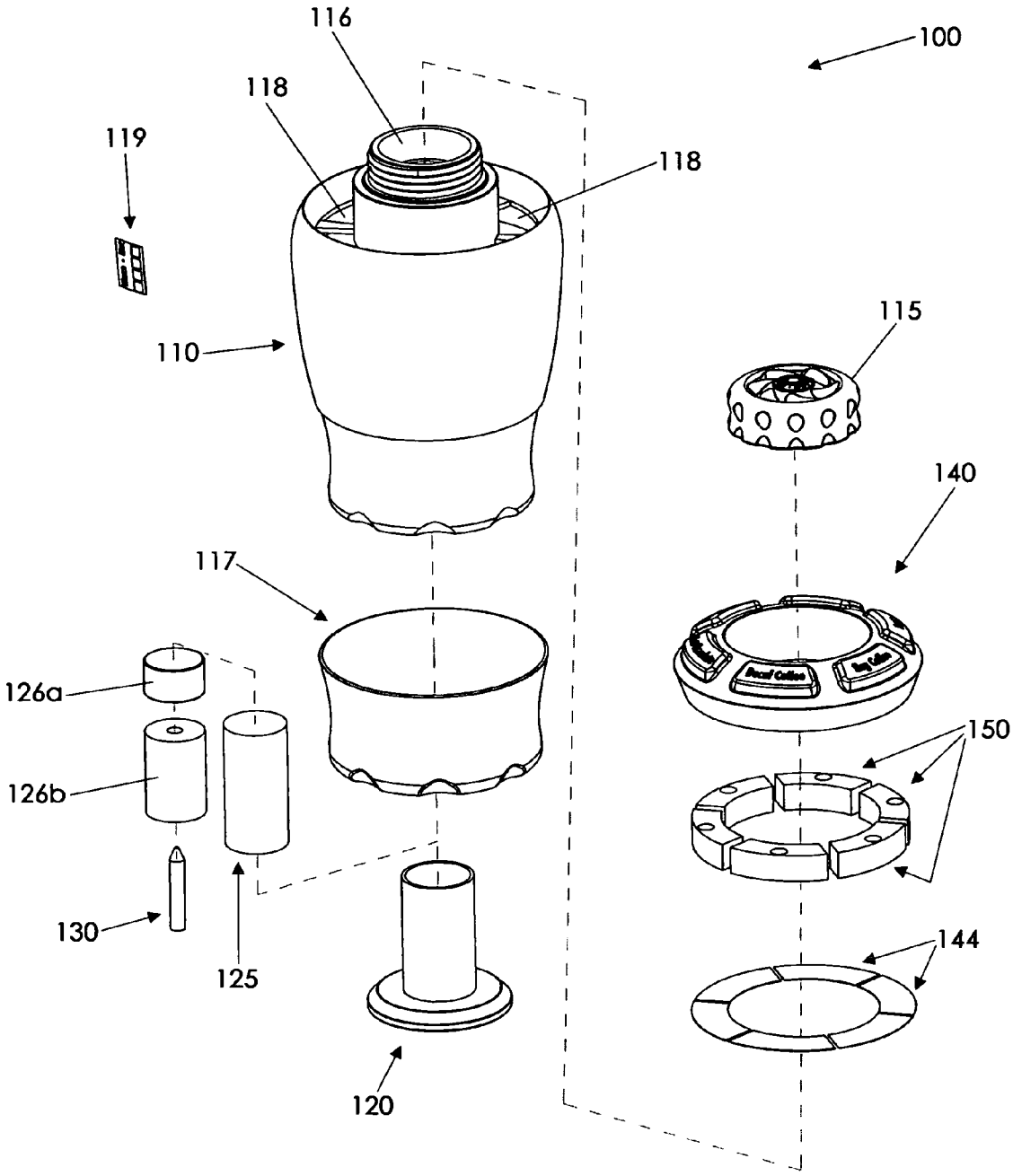
FIG. 4 is an exploded view of the beverage container as in FIG. 1.
Figure 5A:
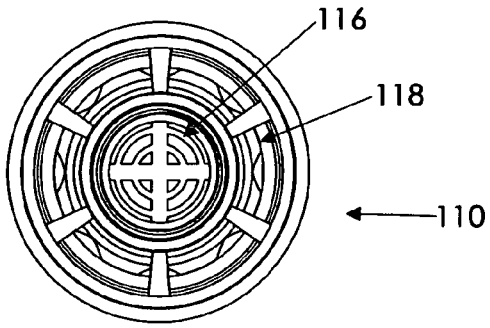
FIG. 5*a* is a top view of the housing with the cap and button removed.
Figure 5B:
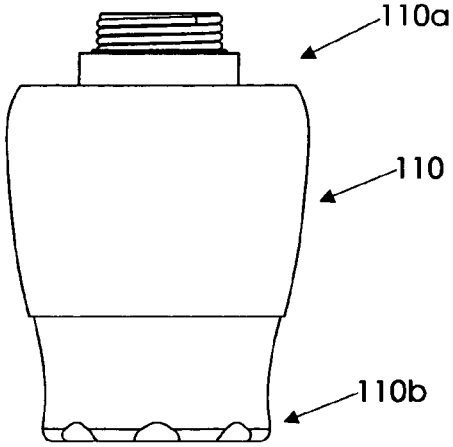
FIG. 5*b* is a side view of the housing as in FIG. 5*a;*
Figure 5D:
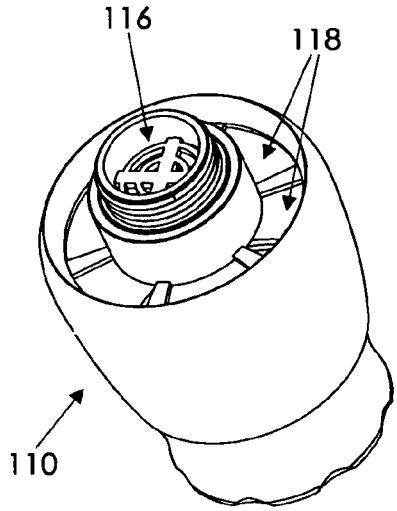
FIG. 5*d* is an elevated view of the housing as in FIG. 5*b;*
Figure 5C:
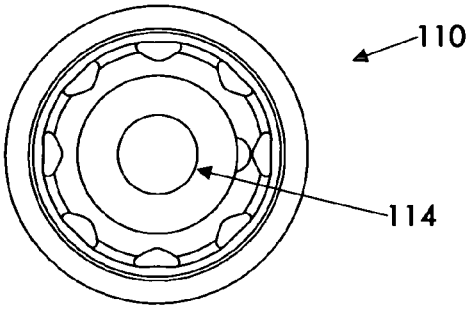
FIG. 5*c* is bottom view of the housing as in FIG. 5*a;*
Figure 6A:
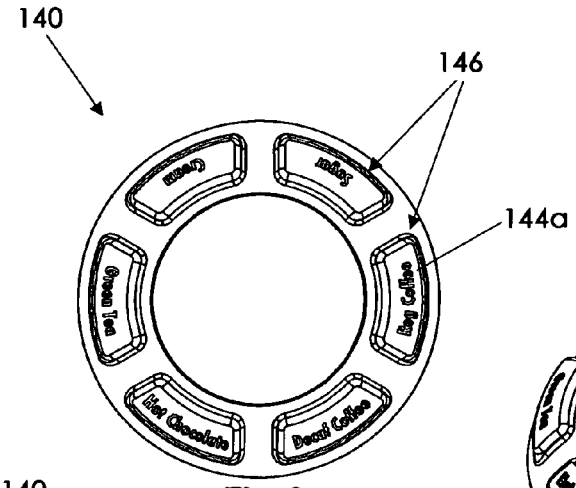
FIG. 6*a* is a top view of a selection portion of the beverage container as in FIG. 1.
Figure 6D:
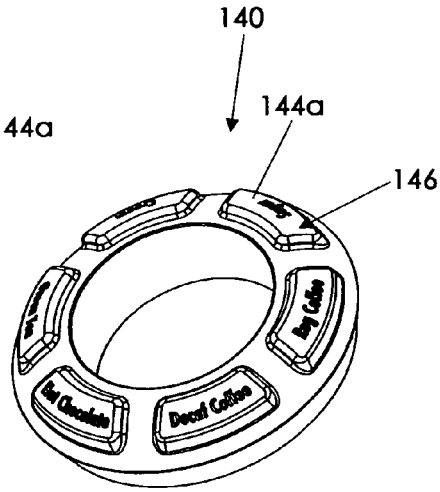
FIG. 6*d* is a perspective view of the selection portion as in FIG. 6*a;*
Figure 6B:
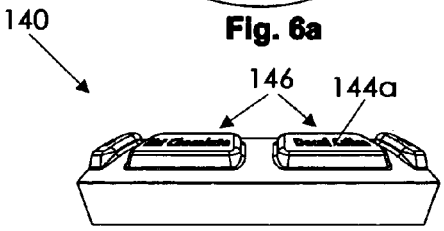
FIG. 6*b* is a side view of the selection portion as in FIG. 6*a;*
Figure 6C:
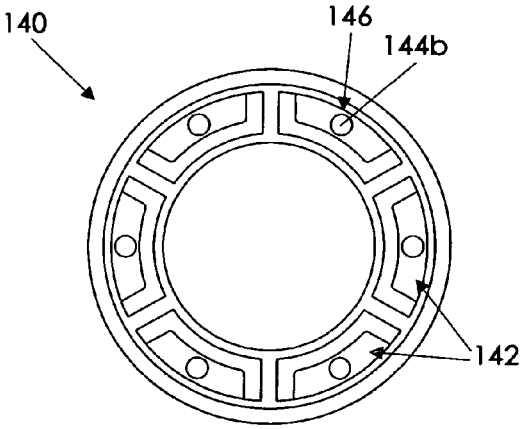
FIG. 6*c* is a bottom view of the selection portion as in FIG. 6*a;*
Figure 6E:
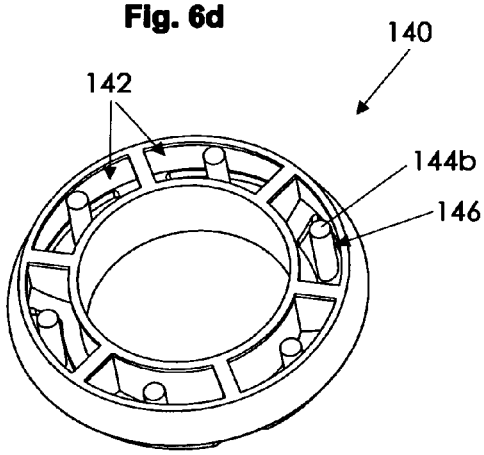
FIG. 6*e* is a perspective view of the selection portion as in FIG. 6*c;*
Figure 7A:
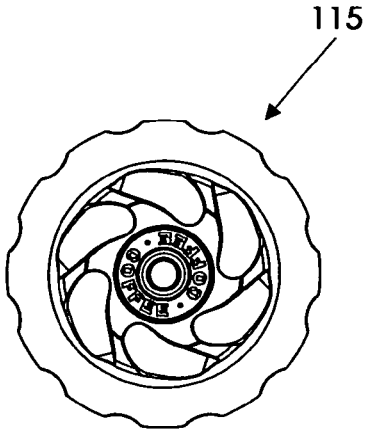
FIG. 7*a* is a top view of a cap of the beverage container as in FIG. 1.
Figure 7B:
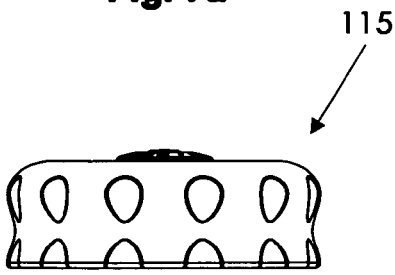
FIG. 7*b* is a side view of the cap as in FIG. 7*a;*
Figure 7C:
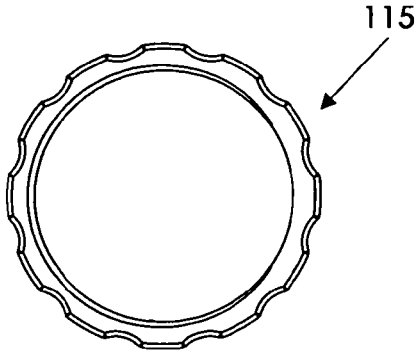
FIG. 7*c* is bottom view of the cap as in FIG. 7*a;*
Figure 7D:
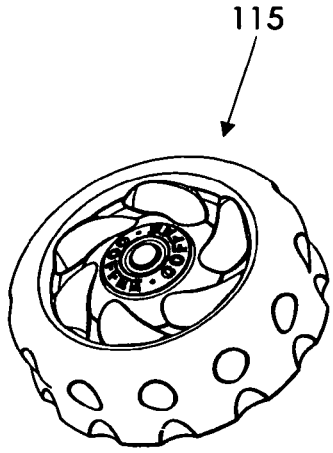
FIG. 7*d* is a perspective view of the cap as in FIG. 7*a;*
Figure 8A:
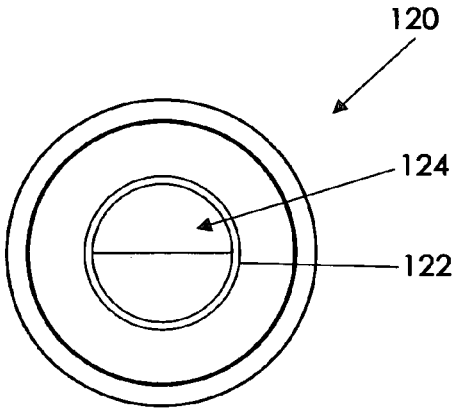
FIG. 8*a* is a top view of the heater portion of the beverage container as in FIG. 1.
Figure 8B:
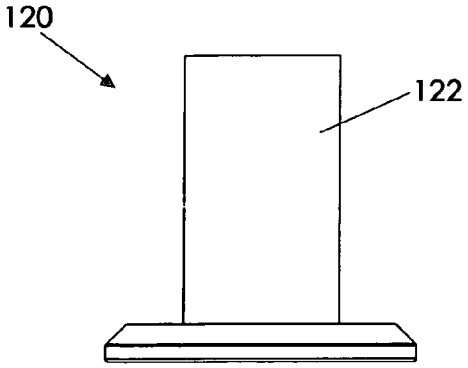
FIG. 8*b* is a side view of the heater portion as in FIG. 8*a;*
Figure 8D:
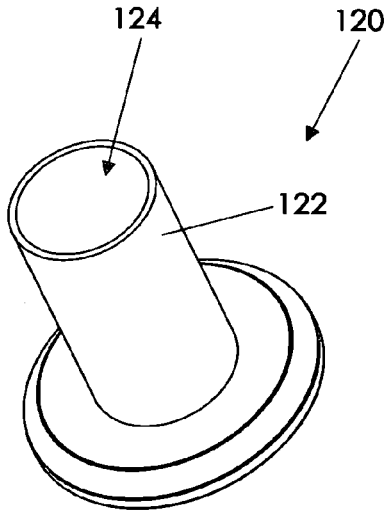
FIG. 8*d* is a perspective view of the heater portion as in FIG. 8*a*.
Figure 8C:
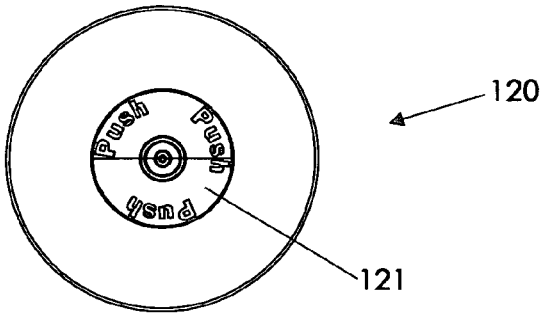
FIG. 8*c* is a bottom view of the heater portion as in FIG. 8*a;*
Figure 9:
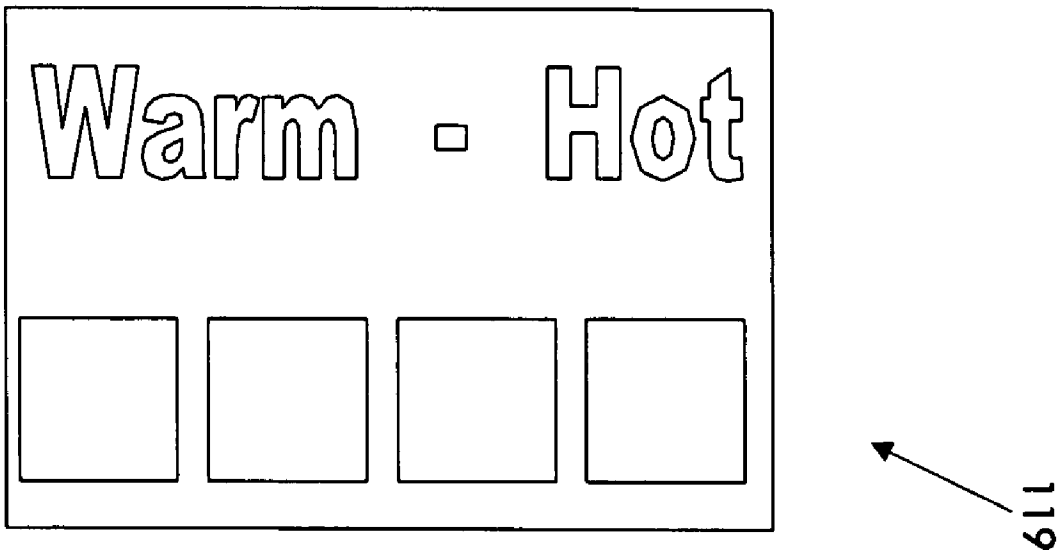
FIG. 9 is an isolated front view of a temperature indicator of the beverage container as in FIG. 1.

The housing 110 further defines a cavity 114 (FIGS. 2*b*, 3*b*, and 5*c*) adjacent and separated from the open interior area 112, a primary opening 116, and at least one secondary opening 118 (FIGS. 5*a* and 5*d*). The cavity 114 may be defined by the lower end 110*b* of the housing 110 (FIGS. 2*b* and 3*b*), and the primary and secondary openings 116, 118 may be defined by the upper end 110*a* of the housing 110 (FIG. 5*d*). A cap 115 may selectively cover the primary opening 116 (FIGS. 1, 2*b*, 3*b*, and 7*a*-7*d*). An elastomer 117 may be overmolded or otherwise coupled to the housing 110 adjacent the lower end 110*b* to provide a non-slip surface to the housing lower end 110*b*, as shown in FIGS. 1 and 4, and a thermometer 119 may be coupled to the housing 110 for displaying a temperature of the interior area 112 and contents of the interior area 112 (FIGS. 1 and 9).

The heater portion 120 may be removably coupled to the housing 110 (e.g., by corresponding structures such as threads, clamps, and/or other fasteners) for selectively heating the open interior area 112 and contents of the open interior area 112. The heater portion 120 may have a wall 122 that defines a cartridge area 124 (FIGS. 8*b*, 8*d*), and the cartridge area 124 may be within the housing cavity 114 when the heater portion 120 is coupled to the housing 110 (FIGS. 2*b* and 3*b*). A cartridge 125 may be receivable in the cartridge area 124 (FIGS. 2*b*, 3*b*, and 4), and first and second reactants 126*a*, 126*b* may be receivable in the cartridge 125 or otherwise receivable in the cartridge area 124 (FIGS. 2*b*, 3*b*, and 4). The first and second reactants 126*a*, 126*b* are selectively combinable to produce heat (e.g., through a chemical reaction), and a seal 128 selectively separates the first and second reactants 126*a*, 126*b* (FIGS. 2*b* and 3*b*). For example, one of the reactants 126*a*, 126*b* may include water, and the other reactant 126*a*, 126*b* may include a magnesium-iron alloy. As should be appreciated, however, other reactants 126*a*, 126*b* may additionally or alternately be used.

Means for puncturing the seal 128 to mix the first and second reactants 126*a*, 126*b* to produce heat may be included. More particularly, the heater portion 120 may include an outer or bottom wall 121, and the means for puncturing the seal 128 may include a spear 130 extending from adjacent the bottom wall 121 into the cartridge area 124. The spear 130 may be movable between lowered and raised positions 130*a*, 130*b* (FIGS. 2*b* and 3*b*), and the movement of the spear 130 from the lowered position 130*a* to the raised position 130*b* may puncture the seal 128, as shown in FIG. 3*b*.

The selection portion 140 has a configuration complementary to a configuration of the housing 110 so that the selection portion 140 may be placed upwardly adjacent the secondary opening(s) 118, as shown in FIGS. 2*b*, 3*b*, and 4, and the selection portion 140 may be selectively separable from the housing 110. The selection portion 140 may define a plurality of chambers 142 (FIGS. 6*c* and 6*e*) for separately housing a plurality of flavoring agents 150 (FIG. 4) so that each flavoring agent 150 is separated from each other flavoring agent 150, and one or more breakable barrier 144 may selectively separate the contents of the respective chambers 142 (e.g., the flavoring agents 150) from the open interior area 112. A plurality of pushable buttons 146 (FIGS. 1, 2*b*, 3*b*, and 6*e*) may be configured to selectively introduce the contents (e.g., the flavoring agents 150) of the respective chambers 142 to the open interior area 112 of the housing 110. If one or more breakable barrier 144 is included as described above, each button 146 may have an accessible activation end 144*a* and a contact end 144*b* that is adjacent a respective breakable barrier 144 or an appropriate portion of the breakable barrier 144 for selectively piercing the breakable barrier(s) 144. Numerous flavoring agents 150 may be utilized, including for example: ground coffee, instant coffee, caffeinated coffee, decaffeinated coffee, tea powder, tea leaves, hot chocolate mix, sweetener, cream, and/or others.

In use, a user may place water, milk, or another consumable liquid 10 (FIGS. 2*b* and 3*b*) in the open interior area 112 of the housing 110, such as through the primary opening 116. The first and second reactants 126*a*, 126*b* may be placed in the cartridge area 124, and the heater portion 120 may be coupled to the housing 110 as described above. Flavoring agents 150 may be placed in the selection portion chambers 142, or a selection portion 140 having flavoring agents 150 may be otherwise obtained. The selection portion 140 may be coupled to the housing 110 upwardly adjacent the secondary opening(s) 118 as described above, and the cap 115 may be coupled to the housing 110 to cover the primary opening 116.

To heat the liquid 10, the spear 130 may be moved from the lowered position 130*a* (FIG. 2*b*) to the raised position 130*b* (FIG. 3*b*), such as by pushing the bottom wall 121. The movement of the spear 130 to the raised position 130*b* may puncture the seal 128, allowing the first and second reactants 126*a*, 126*b* to mix, and the mixture of the first and second reactants 126*a*, 126*b* may cause a chemical reaction that produces heat as described above. This heat may be conducted to the liquid 10 to effectively heat the liquid 10. Either before or after the liquid 10 is heated, one or more of the flavoring agents 150 may be introduced into the liquid 10 by utilizing the selection portion 140. More particularly, one or more button 146 may be pushed at the activation end(s) 144*a*, and the resulting movement of the contact end(s) 144*b* may pierce the breakable barrier(s) 144, allowing the chosen flavoring agent(s) 150 to enter the liquid 10 and create a desired drink. The desired drink may then be consumed through the primary opening 116 by removing the cap 115. The thermometer 119 may be referenced as desired to determine the temperature of the interior area 112 and the associated contents.

It is understood that while certain forms of this invention have been illustrated and described, it is not limited thereto except insofar as such limitations are included in the following claims and allowable functional equivalents thereof.

What is claimed is as follows:

1. A self-heating beverage container, comprising:

a housing having upper and lower ends and defining an open interior area, said lower end defining a cavity adjacent to and separated from said open interior area, said upper end defining a primary opening and at least one secondary opening;

a heater portion removably coupled to said housing, said heater portion having a wall defining a cartridge area and being within said cavity when said heater portion is coupled to said housing;

a first reactant in said cartridge area;

a second reactant in said cartridge area, said first and second reactants being selectively combinable to produce heat;

a cartridge receivable in said cartridge area, said first and second reactants being receivable in said cartridge;

a seal selectively separating said first and second reactants;

means for puncturing said seal to mix said first and second reactants to produce heat;

a selection portion having a configuration complementary to a configuration of said housing for placement upwardly adjacent said at least one secondary opening, said selection portion being selectively separable from said housing;

a plurality of flavoring agents in said selection portion, each said flavoring agent being separated from each other said flavoring agent, each said flavoring agent being selectively separated from said open interior area by at least one breakable barrier;

means for piercing the at least one breakable barrier;

a cap selectively covering said primary opening;

wherein:

said selection portion includes a plurality of pushable buttons, each pushable button having an accessible activation end and a contact end adjacent the at least one breakable barrier;

said means for piercing the at least one breakable barrier includes said plurality of pushable buttons;

said heater portion includes a bottom wall;

said means for puncturing said seal includes a spear extending from adjacent said heater portion bottom wall into said cartridge area, said spear being movable between lowered and raised positions; and movement of said spear from said lowered position to said raised position punctures said seal.

2. The container as in claim 1, wherein said first reactant is water and said second reactant is a magnesium-iron alloy.

3. The container as in claim 1, further comprising an elastomer overmolded to said housing adjacent said housing lower end to provide a non-slip surface to said housing lower end.

4. The container as in claim 1, wherein one said flavoring agent includes coffee and another said flavoring agent includes sweetener.

5. The container as in claim 1, further comprising a thermometer coupled to said housing for displaying a temperature of contents in said housing interior area.

6. The container as in claim 1, wherein:

a respective flavoring agent is a first type of coffee;

a respective flavoring agent is a second type of coffee;

a respective flavoring agent is tea;

a respective flavoring agent is hot chocolate mix;

a respective flavoring agent is sweetener; and a respective flavoring agent is cream.

7. A self-heating beverage container, comprising:

a housing having upper and lower ends and defining an open interior area, said housing defining a cavity adjacent and separated from said open interior area, said housing defining a primary opening and at least one secondary opening;

a heater portion removably coupled to said housing for selectively heating said open interior area;

a selection portion having a configuration complementary to a configuration of said housing for placement upwardly adjacent said at least one secondary opening, said selection portion being selectively separable from said housing, said selection portion defining a plurality of chambers for separately housing a plurality of flavoring agents, said selection portion including a plurality of pushable buttons situated radially about said primary opening and configured to selectively introduce contents of respective chambers to said open interior area;

a cap selectively covering said primary opening;

wherein:

each pushable button includes an accessible activation end and a contact end adjacent the at least one breakable barrier;

a thermometer coupled to said housing for displaying a temperature of contents in said housing interior area;

wherein said heater portion includes:

a wall defining a cartridge area, said cartridge area being within said cavity when said heater portion is coupled to said housing;

a first reactant in said cartridge area;

a second reactant in said cartridge area, said first and second reactants being selectively combinable to produce heat;

a cartridge receivable in said cartridge area, said first and second reactants being receivable in said cartridge a seal selectively separating said first and second reactants;

means for puncturing said seal to mix said first and second reactants to produce heat;

wherein:

said means for puncturing said seal includes a spear extending from adjacent said heater portion bottom wall into said cartridge area, said spear being movable between lowered and raised positions;

movement of said spear from said lowered position to said raised position punctures said seal.

8. The container as in claim 7, further comprising a plurality of flavoring agents in said selection portion, each respective flavoring agent being inside a respective selection portion chamber and being separated from each other said flavoring agent, each said flavoring agent being selectively separated from said open interior area by at least one breakable barrier.

9. The container as in claim 7, wherein said first reactant is water and said second reactant is a magnesium-iron alloy.

10. The container as in claim 7, further comprising an elastomer overmolded to said housing adjacent said housing lower end to provide a non-slip surface to said housing lower end.

11. The container as in claim 7, further comprising a plurality of flavoring agents in said selection portion, each respective flavoring agent being inside a respective selection portion chamber and being separated from each other said flavoring agent, each said flavoring agent being selectively separated from said open interior area by at least one breakable barrier; wherein each pushable button has an accessible activation end and a contact end adjacent said at least one breakable barrier.

* * * * *